United States Patent [19]

May

[11] 3,964,515

[45] June 22, 1976

[54] BY-PASS VALVE WITH PRESSURE RELIEF FEATURE

[75] Inventor: Edward T. May, St. Louis, Mo.

[73] Assignee: ACF Industries, Incorporated, New York, N.Y.

[22] Filed: Dec. 23, 1974

[21] Appl. No.: 535,644

[52] U.S. Cl. ..... 137/625.27; 60/290; 251/85

[51] Int. Cl.[2] ..... F16K 11/02; F16K 31/145

[58] Field of Search ..... 251/61.4, 61.5, 84, 251/85; 137/625.27, 625.5, 115, 119; 60/290

[56] References Cited

UNITED STATES PATENTS

| | | | |
|---|---|---|---|
| 3,085,780 | 4/1963 | Yale | 251/61.5 |
| 3,106,820 | 10/1963 | Schaffer et al. | 60/290 X |
| 3,117,591 | 1/1964 | Schutmaat | 251/85 X |
| 3,430,437 | 3/1969 | Saussele et al. | 137/625.27 X |
| 3,779,280 | 12/1973 | Evans et al. | 137/625.5 |

*Primary Examiner*—Henry T. Klinksiek

[57] ABSTRACT

An air by-pass valve with pressure relief feature is described. The valve is provided with inlet, outlet and by-pass or exhaust ports wherein two valve members are actuated by a diaphragm responsive to engine intake manifold vacuum to direct air from the inlet to the outlet or to the by-pass port as a function of engine intake vacuum and in which the valve members are mounted on a common diaphragm-actuated stem in such a manner that the by-pass valve member can move to open the by-pass port during over-pressure conditions without movement of the diaphragm or valve stem.

3 Claims, 2 Drawing Figures

BY-PASS VALVE WITH PRESSURE RELIEF FEATURE

BACKGROUND OF THE DISCLOSURE

Among the several approaches that have been or are being used to reduce pollution of the atmosphere caused by the automotive internal combustion engine is a system that injects air obtained from an air pump into the exhaust system of the engine. This injected air aids further combustion of the gases which are exhausted by the engine, thus reducing the pollutants discharged into the atmosphere. In some of the more recent proposals these pollutants can be further eliminated by passing the exhaust gases through a catalytic converter. Whether a catalytic converter be used or not, additional air to supply the necessary oxygen for combustion is mandatory.

Control of the air injected into the exhaust system has been found to be necessary in order to avoid certain undesirable consequences. For example, most air pumps used in the type system here involved are belt-driven from the engine. These pumps, being of the positive displacement type, deliver increasing volumes of air at frequently increasing pressures as the speed of the engine is increased. Since only a certain amount of additional oxygen, by way of injected air, is necessary, it is often desirable that the quantity of air be kept within certain maximum limits. Also, it is desirable that the pressure in the air system be held within reasonable limits in order to avoid unnecessary stresses on the pump and the imposition of additional horsepower requirements upon the engine. Moreover, in those systems utilizing catalytic converters, it is advisable to limit the air injected during certain modes of operation to prevent overheating and consequent destruction of the catalyst system. It is frequently desired to terminate air injection into the exhaust system whenever the engine is operating under very heavy load conditions, when manifold vacuum is very low and also to reduce or eliminate air injection if there is any loss of manifold vacuum caused by any malfunction or damage to any part of the system.

Pressure relief and air by-pass valves are known and an example of such a valve is disclosed in the to Crawford et al, U.S. Pat. No. 3,520,320, dated July 14, 1970. Such valves have performed very satisfactorily for their intended purpose, but do not fully meet all of the newer requirements that are presently being imposed as overall emissions technology changes.

Accordingly, among the objects of the present invention are to provide a by-pass and pressure relief valve for the air injection system of an automotive internal combustion engine. An additional object of the invention is to make provision for exhausting or venting excess air without interrupting or unduly reducing air delivery to the engine exhaust system.

SUMMARY OF THE INVENTION

In accordance with the present invention, a three-ported valve is provided having features that will permit passage of air from the air pump to the air injection system of the engine when such required, provision for overpressure relief, such as would occur at high engine rpm, and further provision for closing a valve member to prevent injection of air into the air injection system and to vent such air to the atmosphere during certain preselected modes of engine operation.

DETAILED DESCRIPTION OF THE INVENTION

Figure 1:
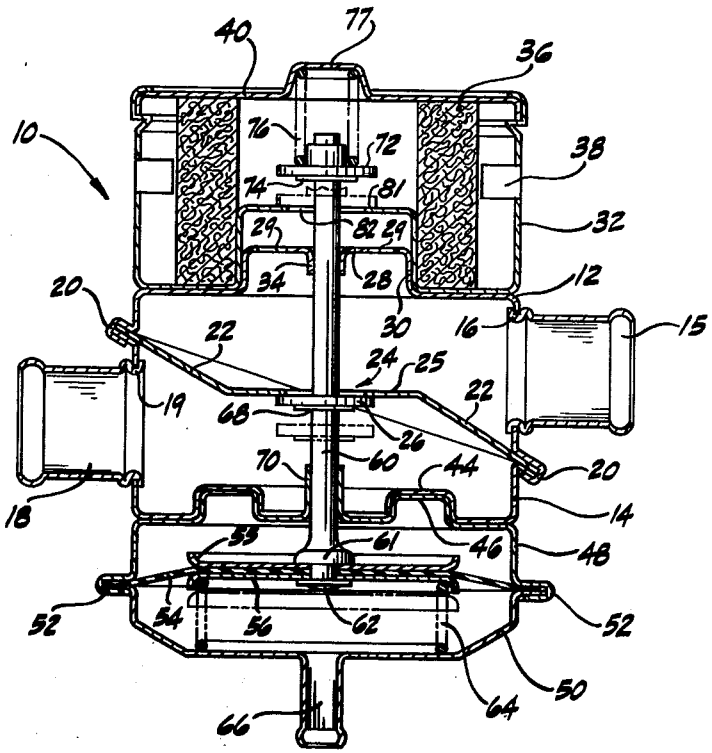
FIG. 1 is a sectional view of an air by-pass and pressure relief valve according to the invention illustrating a form of construction utilizing sheet metal parts and showing the application of vacuum to one side of a diaphragm member.

In FIG. 1 there is shown a valve 10 having a central body section made up of an upper sheet metal part 12 and a lower sheet metal part 14. An inlet nipple 15 is crimped as at 16 to secure the same in body member 12. An outlet nipple 18 is crimped in place as at 19 in a manner similar to that of the inlet nipple. Upper body member 12 and lower body member 14 are crimped together at 20 and interposed in the crimped joint is a web 22 having a central opening 24. The periphery of opening 24 constitutes a valve seat 25 for a valve member 26 to be described hereinafter.

A central portion 28 of body member 12 is deformed outwardly to provide a shoulder 30 for receiving a filter housing 32. Portion 28 also has a reversely deformed section 34 which is open at the center and which thereby provides a stem guide. A plurality of openings 29 are located in the outwardly displaced portion 28 to provide a passageway for air.

Filter housing 32 contains a filter element 36 which is generally circular in nature and is constructed of a porous material such as to attenuate sound when air is flowing through it. To provide exit of air from the filter chamber a plurality of openings 38 are provided. Chamber 32 is closed by a cover plate 40 which can be pressed or snapped in place. Lower body member 14 is provided with a circular recess 44 which receives a similarly shaped boss 46 which is an upward extension from upper diaphragm housing 48. Crimped to housing 48 is a lower housing 50 and housing 48 and 50 together define a diaphragm chamber. Housing 48 and housing 50 are crimped together as at 52 and thereby secure between the two housing members a diaphragm 54. Diaphragm 54 is provided with backing plates 55 and 56 which are secured to a stem 60 by collars 61 and 62. A spring 64 within housing 50 bears against backing plate 56. Thus, spring 64 biases the diaphragm assembly in an upward direction as shown. A hose nipple 66 is located in a portion of housing 50 so that engine manifold vacuum can be applied by way of a hose to the lower side of diaphragm 54. Spring 64 will be selected to exert a predetermined bias so that vacuum greater than a certain amount will draw the diaphragm down and vacuum less than this given amount will allow the diaphragm to rise. By way of example, spring 64 can be selected so that manifold vacuum greater than 6 inches of mercury will draw diaphragm 54 downwardly while vacuum less than 6 inches of mercury will allow diaphragm 54 to rise.

Valve head 26 is positioned on stem 60 and prevented from sliding along stem 60 by a stop member 68. Thus, when diaphragm 54 is forced upwardly by spring 64, valve stem 60 will rise and the stop member 68 will cause the valve head 26 to engage valve seat 25 thereby preventing flow of air from inlet nipple 15 to outlet nipple 18.

Housing member 48 at its center is provided with an aperture having a turned-up lip 70 to serve as a lower guide for valve stem 60. At the upper end of stem 60 there is positioned a by-pass valve head 72 which is slideably received on stem 60. A stop member 74 limits the travel of valve head 72 in a downward position as shown. A biasing spring 76 engages a recess 77 in cover plate 40 at one end and rests upon valve head 72 at its other end. Spring 76 will be selected to exert a bias that will allow valve head 72 to move away from its valve seat whenever the pressure within the by-pass valve assembly exceeds a predetermined amount. The seat for valve head 72 is indicated at 81. Valve seat 81 is an integral portion of filter housing 32 and is created by bending and forming a portion of the housing to create the necessary flat valve seat surface. Seat 81 has a central opening 82 for passage of air.

For an understanding of the operation of the FIG. 1 embodiment, it must be kept in mind that the bias of spring 64, the diameter of the diaphragm 54, the valve seat area 25, and the valve seat area 81 will be selected to conform to predetermined conditions. The effective diameter of the diaphragm 54 working against the bias of spring 64 will determine the vacuum which must be applied to pull the diaphragm down. Also, it is to be borne in mind that the air pressure from the air pump will work against valve head 26 tending to force it in an open direction. The area of valve seat 81 will determine the effective force which is exerted against valve head 72 to force it in an upward direction. Spring 76 then will be chosen to allow valve head 72 to open against a predetermined inlet pressure. In any event, when the by-pass valve of the invention is in normal operation, vacuum will be applied at nipple 66 drawing diaphragm 54 down and moving valve head 26 away from the seat 25. At this time, valve head 72 is drawn down against valve seat 81. Under these circumstances, air from the pump enters the by-pass valve through nipple 15 and is passed through the opening defined by valve seat 25 and out through nipple 18. In the event an overpressure condition is created, such as through increased engine rpm, then valve head 72 will be forced upwardly against the bias of spring 76 to vent a portion of the air through the filter 36 and out the openings 38 without the necessity of moving the valve stem 60 or diaphragm 54.

Upon loss of vacuum from the engine which may occur during wide-open throttle operation, the spring 64 will force diaphragm 54 and stem 60 in an upward direction, thus causing valve head 26 to seat against valve seat 25 shutting off air flow to the exhaust system of the vehicle and, at the same time, valve head 72 will be forced upwardly, thus permitting air to by-pass through the filter and exit by way of openings 38.

In a similar manner, if some accidental interruption of vacuum to nipple 66 occurs, the operation just described will occur and air will be by-passed away from the exhaust system. Such accidental interruption might occur if the vacuum hose connecting the nipple 66 to the intake of the engine is dislodged or if it is damaged in some way. The loss of vacuum to the operative diaphragm of the by-pass valve of the invention would, in all cases, result in the cessation of air flow to outlet nipple 18 and the exit of air from the valve by way of by-pass port opening 82, thus ensuring that no air would be delivered to the exhaust system. In this manner inadvertent damage to the exhaust system components will be avoided during the interval preceding corrective action.

Figure 2:
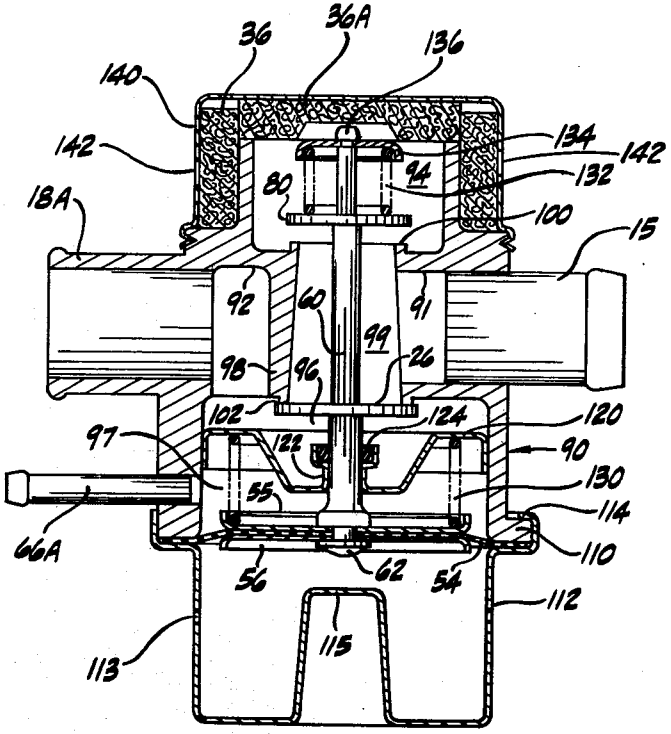
FIG. 2 is a sectional view of a valve according to the invention illustrating a body member of die cast construction and further showing a vacuum connection to an opposite side of a diaphragm member.

Referring now to FIG. 2 of the drawing, there are two apparent differences in that the materials of construction have been changed to illustrate the use of a die cast body member which defines the three ports of the valve and, also to illustrate the use of vacuum applied to an opposite side of the actuating diaphragm, which feature presents still another mode of operation which may be desirable under some circumstances.

In FIG. 2 die cast body member 90 is provided with an inlet nipple 15 pressed into an inlet opening 91. Outlet 18A of the FIG. 2 embodiment is integrally casted into the body member 90. A web 92 divides and isolates upper vent space 94 from lower discharge space 96 and web 92 supports a cylindrical portion 98 which constitutes an air passageway 99 and also provides an upper seat 100 and a lower seat 102. Seats 100 and 102 correspond in most functional respects to seats 80 and 25 in FIG. 1.

Diaphragm 54 is secured to a lower lip 110 of the body member 90 by a can 112 which is crimped over lip 110 as at 114 to secure the diaphragm tightly in place. Diaphragm 54 is provided with upper and lower diaphragm plates 55 and 56 which are secured to diaphragm stem 60 by heads 61 and 62. Can 112 is vented to the atmosphere by way of one or more vents 113 and is also provided with an upwardly projecting boss 115 which serves as a limit stop for stem 60 whenever diaphragm 54 moves in a downwardly direction in that head 62 will contact the boss 115 thereby limiting the movement of stem 60.

A divider plate 120 is pressed into valve body 90 as shown and divides the valve body into compartment 96 and compartment 97. A central portion of divider 120 is turned up at 122 to provide a guide surface for stem 96 and also to receive packing 124 to seal space 96 from space 97. A vacuum connection 66A is pressed into valve body 90 to communicate space 97 with a vacuum source such as the intake manifold of the engine.

A biasing spring 130 is interposed between diaphragm plate 55 and divider plate 120 to urge the diaphragm and stem 60 in a downward direction. Stem 60 is provided with a valve member 26 which rests on a shoulder of the stem and is also provided with a second valve member 80 which rests on a second smaller diameter shoulder of stem 60. Valve members 26 and 80 are spaced apart to coact with valve seats 102 and 100 respectively. Surmounting valve 80 is a biasing or pressure relief spring 132 which rests at one end on valve member 80 and which is retained at its other end by valve plate 134 which is held in place on the end of stem 60 by an upset head 136. The remainder of the by-pass valve structure of FIG. 2 constitutes a muffler can 140 having a plurality of outlet openings 142 to permit the venting of pumped air to the atmosphere. Inside the muffler container 140 there is placed a filter element 36 of cylindrical nature as well as a filter pad 36A. The filters 36 and 36A provide a passageway from the space 94 to the outlets 142 and because of the nature of the filter medium serve to act as mufflers or air silencers to reduce the noise created by the escape of pressured air to the atmosphere.

The operation of the FIG. 2 embodiment is somewhat different from that of FIG. 1 and yet retains of the same operating features. With no vacuum applied to nipple 66A such as would occur with a dead engine or under wideopen throttle conditions, biasing spring 130 would drive diaphragm plate 155 and diaphragm 54 in a downward direction and valve member 26 would be moved away from valve seat 102 to permit communication of inlet air from inlet 15 to the outlet 18A. At the same time, valve member 80 would be drawn down against valve seat 100. Biasing spring 130 would be selected to have a bias such that valve stem 60 and valve members 26 and 80 would remain in the just-described condition at all engine operating conditions in which intake manifold vacuum was at or below some preselected amount. For example, spring 130 could be chosen to that valve 26 would be off its seat and valve member 80 on its seat at all times when the engine is operating under normal loads or even accelerating and this would represent intake manifolds vacuums of those equivalent to curb idle, normal cruise, e.g. 16 to 18 inches of mercury vacuum, and all conditions of acceleration when the vacuum approaches atmospheric pressure. In this manner, whenever the engine is running the air pump would be in operation delivering air to inlet nipple 15 and the valve would discharge air by way of outlet nipple 18A more or less as a function of engine rpm which would determine the speed of the air pump and, therefore, the volume delivered by the air pump to the valve.

Under conditions of deceleration, the vacuum at inlet 66A would rise sharply, the bias of spring 130 would be overcome and valve member 26 would be driven upward toward seat 102 to shut off communication between inlet 15 and outlet 18A.

Under the just-described conditions, valve stem 60 would have moved in an upward direction lifting valve member 80 off seat 100 and all air pumped through inlet 15 would then exit into space 94 passed through filters 36 and 36A to vent ports 142 to be exhausted to the atmosphere.

Considering normal operation with valve 26 off its seat, increasing engine speed will increase the pressure of the air delivered by the pump and this increased pressure acting upon valve member 80 will tend to overcome the bias of spring 132. Whenever the pressure within space 99 exceeds the biasing force of spring 132, valve member 80 will lift off its seat 100 and pass a proportionate quantity of air into the space 94 to be exhausted to the atmosphere. Since this condition normally exists at higher engine rpm's, the venting of a portion of the air will reduce the quantity of air delivered through outlet nipple 18A and, thus, deep the total quantity of air delivered to the exhaust system of the engine within certain predetermined bounds. The ratio of by-passed or vented air to air delivered to the exhaust system can be controlled by selecting the bias of spring 132 as well as the effective diameters of seats 100 and 102.

When the vehicle is operating in a normal cruise and changes into a deceleration mode, the vacuum at nipple 66A will increase rapidly, thus overcoming the bias of spring 130 causing stem 60 to rise and the valve 26 to close seat 102 and the valve 80 to move away from the seat 100. Thus, during deceleration conditions all air may be vented to the atmosphere.

From the foregoing, it is apparent that both the FIG. 1 and FIG. 2 versions of the by-pass valve have the capability of performing the desired functions of providing air to the exhaust system of the engine during modes of operation as determined by requirements at the time and each version is further capable of venting air during conditions of overpressure without movement of the diaphragm and valve stem of the valve unit.

I claim:

1. An air by-pass and pressure relief valve having a valve body, an inlet port, an outlet port and a by-pass port in said valve body, a wall dividing said valve body, said wall having an opening therethrough to define a main valve seat, a diaphragm housing secured to a first end of said valve body, a diaphragm secured to said valve body by said diaphragm housing, said diaphragm defining a vacuum chamber and a second chamber, a vacuum inlet fitting into said vacuum chamber, a valve stem secured to said diaphragm by a pair of backing plates, one on each side of said diaphragm, a biasing spring abutting one of said backing plates to bias said diaphragm in a first direction opposing the bias of vacuum applied to said vacuum inlet fitting, biasing spring confining means constituting a vacuum chamber closure, said air by-pass and pressure relief valve further comprising A. an outlet valve head slideably mounted on said valve stem and positioned by a first shoulder on said stem, said outlet valve head operable to open and close said main valve seat, B. a by-pass valve head slideably mounted on said valve stem and positioned by a second shoulder on said stem, said by-pass valve head operable to open and close a by-pass valve seat port defined by a by-pass valve seat in a partition separating said valve body from at least one by-pass discharge opening, and C. a by-pass valve biasing spring abutting said by-pass valve head to bias said by-pass valve head toward the said by-pass valve seat during normal operation but moveable away from said by-pass valve seat on over pressure conditions, said by-pass valve biasing spring also abutting a spring retaining member fastened to an end of said stem opposite said diaphragm.

2. The valve of claim 1 in which the said by-pass valve discharges into a filter chamber having a filter element therein and a filter housing therearound, said filter housing being secured to said valve body and having at least one discharge outlet opening.

3. The valve of claim 1 in which the said vacuum inlet nipple communicates with said vacuum chamber on a side of said diaphragm toward said outlet valve head and in which the said biasing spring abutting one of said backing plates exerts a bias sufficient to resist the vacuum created by an engine during normal driving but insufficient to overcome the increased vacuum of deceleration.

* * * * *